US006847340B2

(12) United States Patent
Wang et al.

(10) Patent No.: US 6,847,340 B2
(45) Date of Patent: Jan. 25, 2005

(54) ACTIVE ORGANIC LIGHT EMITTING DIODE DRIVE CIRCUIT

(75) Inventors: Wen-Chun Wang, Taichung (TW); Wen-Tui Liao, Taichung (TW); Chien-Chung Kuo, Feng-Yuan (TW); Hsi-Rong Han, Taichung Hsien (TW)

(73) Assignee: Windell Corporation, Taichung (TW)

( * ) Notice: Subject to any disclaimer, the term of this patent is extended or adjusted under 35 U.S.C. 154(b) by 306 days.

(21) Appl. No.: 10/222,528

(22) Filed: Mar. 16, 2002

(65) Prior Publication Data

US 2004/0046719 A1 Mar. 11, 2004

(51) Int. Cl.[7] ..... G09G 3/30
(52) U.S. Cl. ..... 345/76; 345/77; 315/169.3
(58) Field of Search ..... 345/76, 77, 78, 345/79, 80, 82, 84, 204, 55; 315/169.3

(56) References Cited

U.S. PATENT DOCUMENTS 6,433,488 B1 * 8/2002 Bu ..... 315/169.3
6,693,388 B2 * 2/2004 Oomura ..... 315/169.3

* cited by examiner

*Primary Examiner*—Albert Decady
*Assistant Examiner*—Fritz Alphonse
(74) *Attorney, Agent, or Firm*—Birch, Stewart, Kolasch & Birch, LLP

(57) ABSTRACT

The present invention relates to an uniformly active light emitting diode drive circuit. This invention provides a 3T1C circuit structure in the emitting pixel and an additional data capacitors connecting to all the pixels are picked out and located on one side of the display panel. In addition, the connecting lines to the OLED on every pixel are all collected to one end of a transistor Moc on the other side of the display panel. Through the arrangement, it is intended that the aperture ratio of the organic electroluminescent (OLED) device can be largely improved. Moreover, an additional by-pass current transistor in parallel with data capacitor (Cd) in a data generator region outside of the pixel array can by-pass the previous left current in the circuit and thus enhance the contrast ratio of the emitting pixel.

24 Claims, 10 Drawing Sheets

ACTIVE ORGANIC LIGHT EMITTING DIODE DRIVE CIRCUIT

FIELD OF THE INVENTION

The present invention pertains to organic electroluminescent device, and more specifically to an active organic electroluminescent drive circuit structure for improving the uniformities and contrast in organic electroluminescent devices.

BACKGROUND OF THE INVENTION

Matrix displays are well known in the art, where pixels are illuminated using matrix addressing as illustrated in FIG. 1. A typical passive matrix organic electroluminescent display 100 comprises a plurality of picture or display elements (pixels) 160 that are arranged in rows and columns. The display incorporates a column data generator 110 and a row select generator 120. In practical operation, each row is sequentially activated via row line 130, where the corresponding pixels are activated using the corresponding column lines 140. In a passive matrix display, each row of pixels is illuminated sequentially one by one, whereas in an active matrix display, each row of pixels is first loaded with data sequentially. Namely, each row in the passive matrix display is only "active" for a fraction of the total frame time, whereas each row in the active matrix display can be set to be "active" for almost the entire total frame time.

A typical active matrix organic electroluminescent display has been achieved in the prior art (See U.S. Pat. No. 6,157,356). In this patent, as shown in FIG. 2, the emitting pixel includes a switch transistor M1 230, a drive transistor 240, a data line 210, a select line 220, a storage capacitor Cs 250, a power supply Vdd 270 and an OLED 260. With use, the gate to source voltage (threshold voltage) of the "drive transistor" M2 may vary, thereby causing a change in the current passing through the OLED. This varying current contributes to the nonuniformity in the intensity of the display. Sometimes, in this scheme due to the production quality of the drive transistor M2 240, it would lead to a consequence that ultimately produces threshold voltage variations in the pixels.

Another contribution to the nonuniformity in intensity of the display can be found in the manufacturing of the "drive transistor". In some cases, the "drive transistor" is manufactured from a material that is difficult to ensure uniformity of the transistors such that variations exist from pixel to pixel.

Significant improvement in threshold voltage variations has been achieved in the prior art (See U.S. Pat. No. 6,229,506). In this patent, a design of four transistors two capacitors (4T2C) structure to compensate the threshold voltage of the drive transistor in each pixel was demonstrated to improve the uniformity in the intensity of the emitting pixels. However, in this scheme as shown in FIG. 3. The pixel structure adopts a data line 310, a scan line 320, a power supply Vdd line 305, an AZ line 390 and AZb control line 395, four transistors 330, 340, 370, 350, auto-zero capacitors 355, 380 and an OLED 360. In this scheme, the addition of the transistor is used to compensate the threshold voltage of the drive transistor M2 340 in order to improve the uniformity of the emitting pixel. However, the addition of the device components occupy too much space in the tiny pixel structure and brings aperture ratio loss, moreover, there is always accompanying a contrast problem when conducting the auto-zero period, a slight current will run through organic electroluminescent (OLED) devices thus tends to reduce the contrast of the emitting pixel.

FIG. 4 depicts a schematic diagram of a time domain of the control signal in accordance with the FIG. 3, the time domain is separated as the auto-zero threshold voltage period and write data period. Before conducting the auto-zero period, M1 330, M3 370 are off, M2 340 and M4 350 are on, during this time period, the current running through OLED is the current of the previous frame time. Then after a while, M1 330 is on, then M3 370 is on sequentially, thus a connection of the drain and the gate of M2 340 can be conducted as a diode. Then after a while, M4 350 is off, then the current voltage of gate of M2 340 raise to a value of Vdd-Vth (threshold voltage). At this instant, the M3 370 is off, then the threshold voltage of M2 340 will be recorded in the capacitor C2 355, thus fulfill the auto-zero action.

It is a purpose of this invention to provide a new method to improve the uniformity of the emitting pixel and meanwhile to improve the aperture ratio of the organic electroluminescent (OLED) device.

It is another purpose of this invention to provide a new organic electroluminescent (OLED) device for display with improved contrast problem.

SUMMARY OF THE INVENTION

The above problems and others are at least partially solved and the above purposes and others are realized in an organic electroluminescent device shown as follow:

According to the present invention, there is first obtained a three transistor one capacitor (3T1C) structure in every single pixel and the data capacitors (Cd) connecting to the three transistor one capacitor (3T1C) structure of every pixel are picked out and collected into a data generator region on one side of the display panel. In addition, the connecting lines to the OLED of every pixel are all collected to one end of a transistor Moc on the other side of the display panel.

Through the arrangement mentioned above, it is intended that the uniformity of the emitting pixels and the aperture problems of the organic electroluminescent (OLED) device can be largely improved.

In another preferred embodiment, through another arrangement in the design of the circuit, the addition of a by-pass current transistor Mby which is in parallel with data capacitor (Cd) in the data generator region, the function of the by-pass current transistor Mby device can easily reduce the current when conducting the auto-store threshold voltage period and enhance the contrast of the emitting pixel during their operation.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE INVENTION

Figure 1:
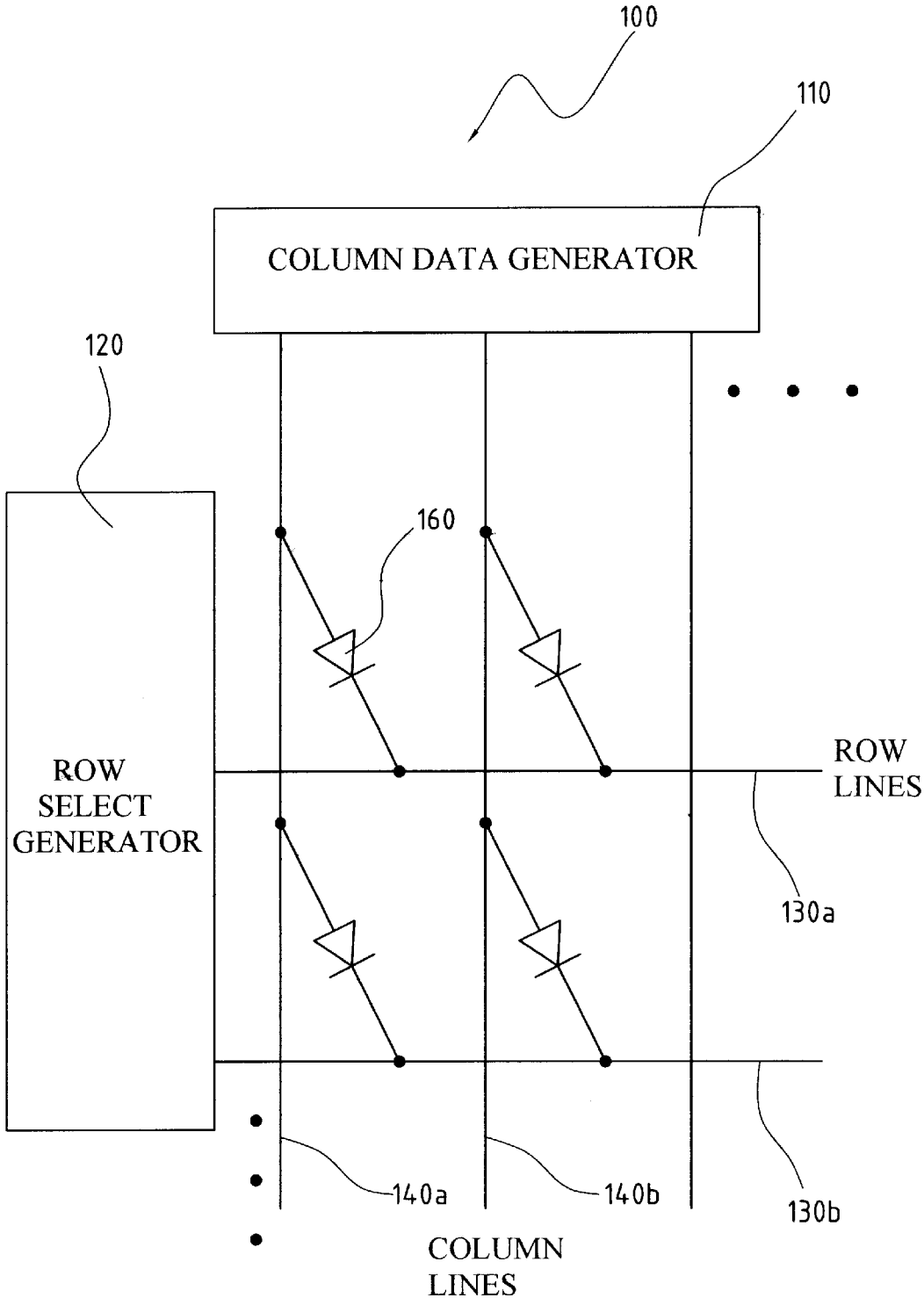
FIG. 1 (PRIOR ART)
FIG. 1 depicts a block diagram of a passive-matrix addressing display.
Figure 2:
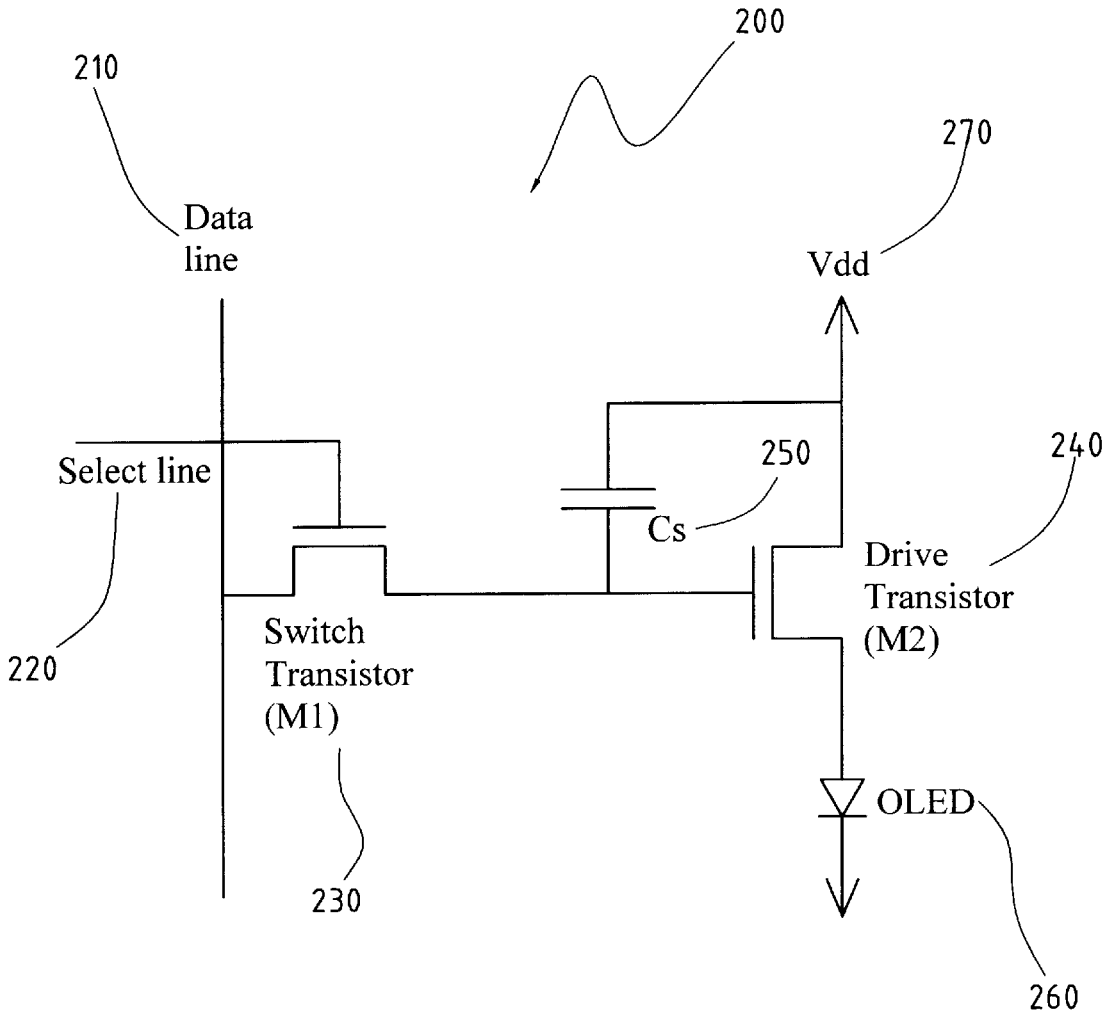
FIG. 2 (PRIOR ART)
FIG. 2 depicts a two transistors and a storage capacitor circuit structure (prior art)
Figure 3:
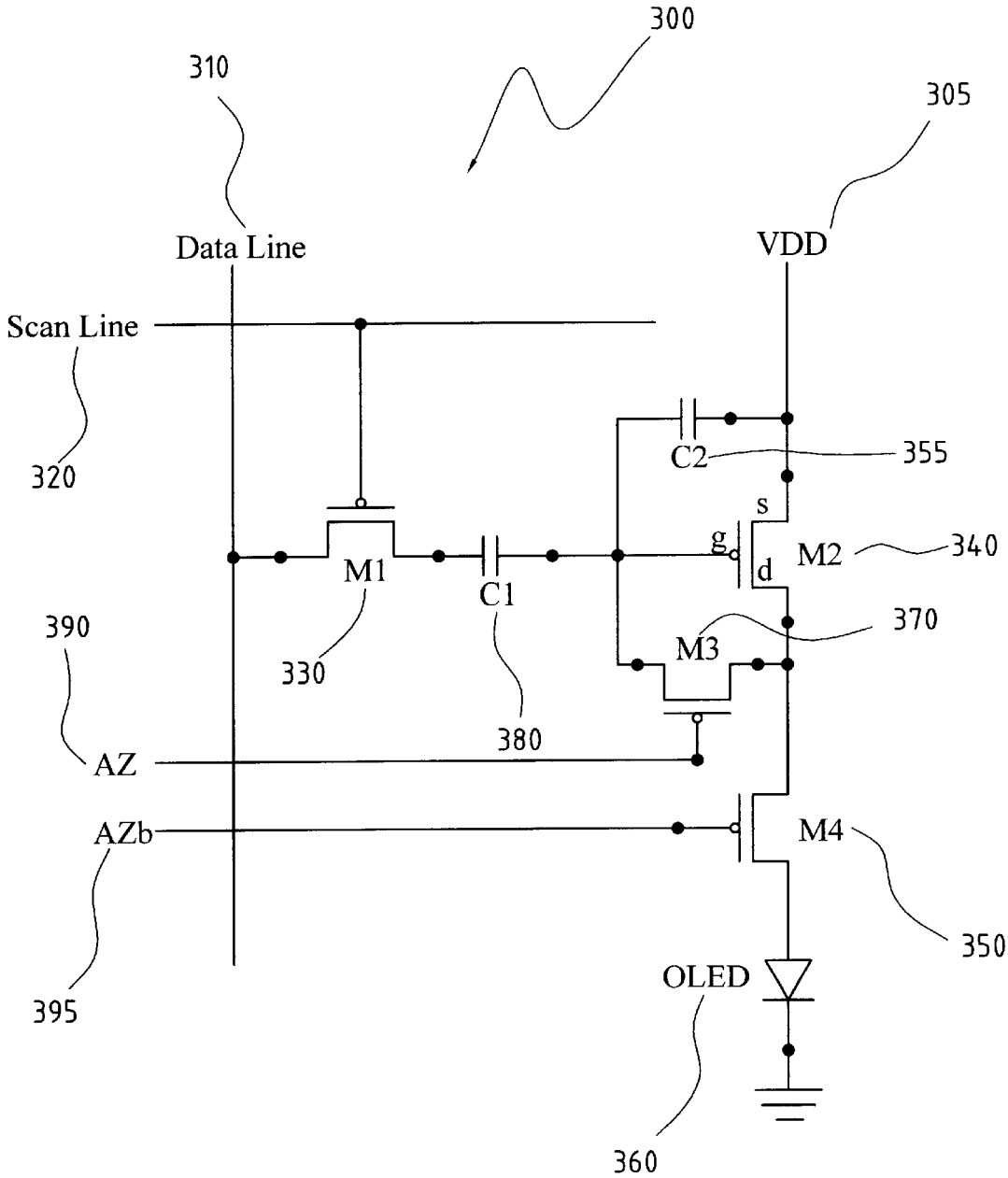
FIG. 3 (PRIOR ART)
FIG. 3 depicts a four transistors and two capacitors circuit structure (prior art)
Figure 4:
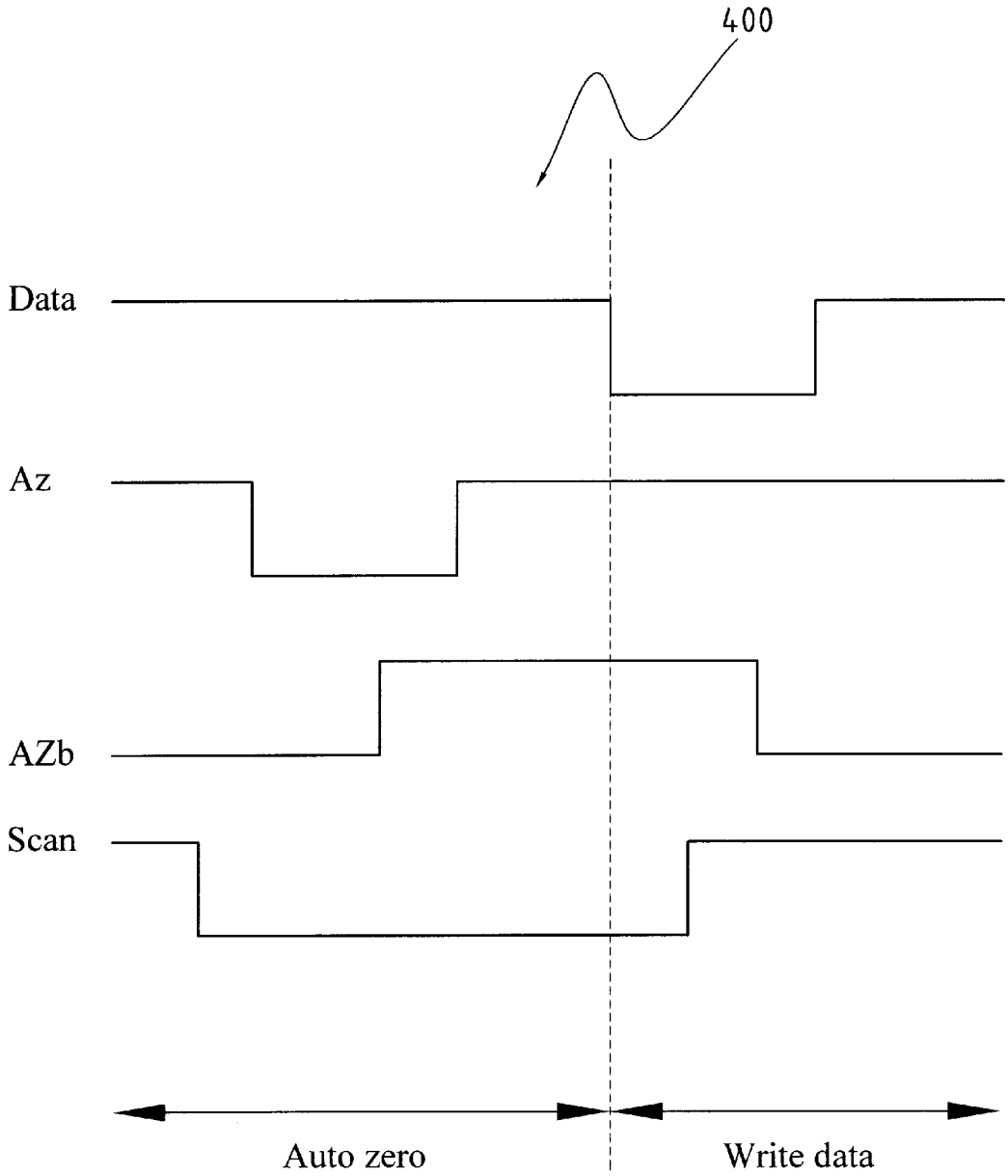
FIG. 4 (PRIOR ART)
FIG. 4 depicts a drive circuit time domain diagram of a four transistors and two capacitors circuit structure (prior art)
Figure 5:
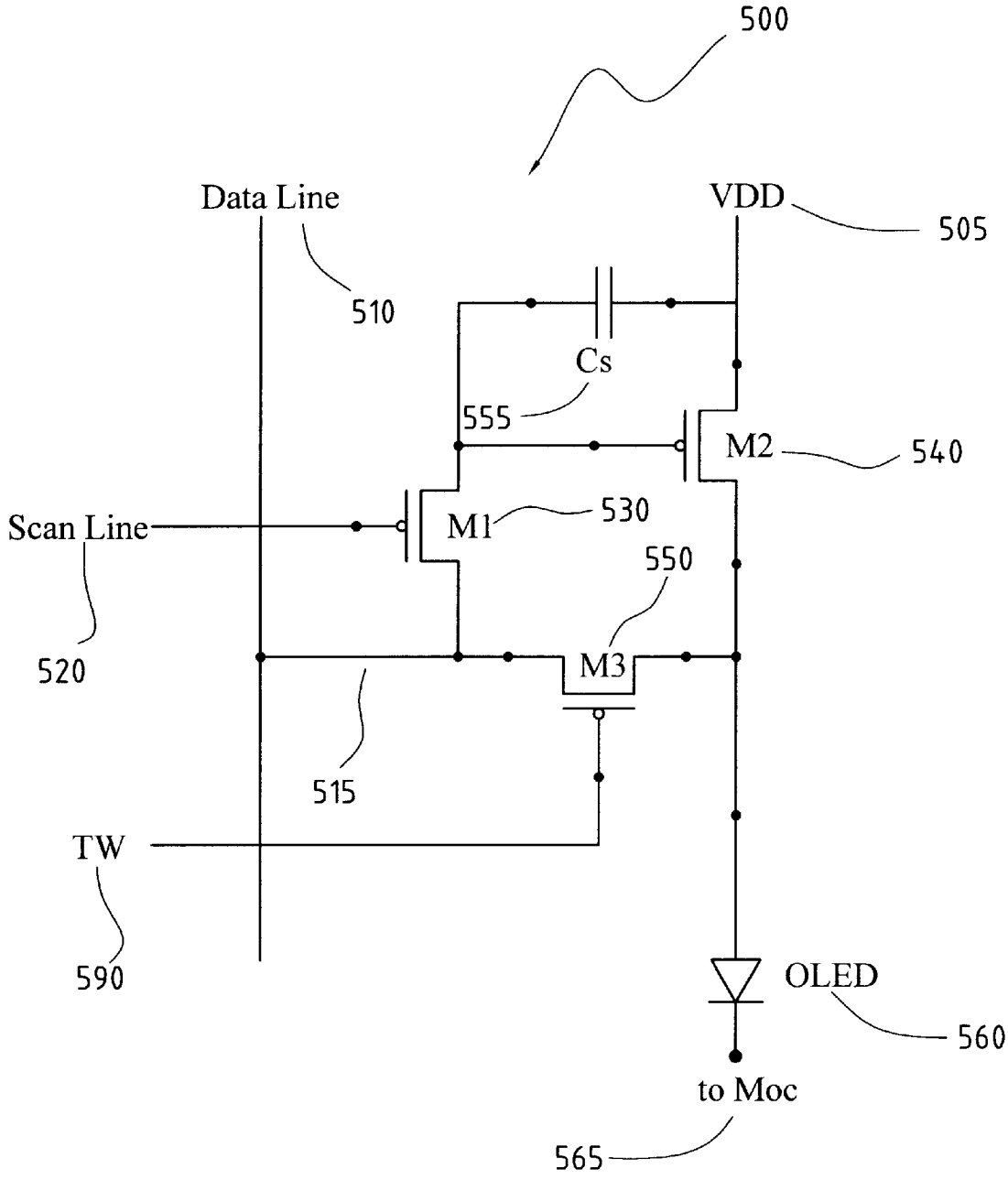
FIG. 5 depicts a three transistors one capacitor and the data capacitor embedded in a data generator pixel structure of the present invention.

FIG. 5 depicts a schematic diagram of an active matrix OLED pixel structure 500 of the present invention. In the preferred embodiment, the active matrix OLED pixel is implemented using LTPS thin film transistors OLED or a-Si thin film transistors OLED, e.g., transistors manufactured using amorphous or poly-silicon, or crystal-silicon. Although the present pixel structure is implemented using thin film transistors and an organic illuminescent device, it should be understood that the present invention be implemented using other types of transistors and light emitting diodes.

Referring to FIG. 5, pixel structure 500 comprises three PMOS transistors 530, 540, 550, a storage capacitor Cs 555, an OLED 560 (light element) and a transistor Moc 565. A scan line 520 is connected to the gate of transistor 530. A TW line 590 is connected to the gate of the transistor 550. A data line 510 is connected to the drain of the transistor 550, 530 and a power supply Vdd line 505 is connected to the source of the transistor 540 and one end of the storage capacitor Cs 555 while the other end of Cs 555 line is connected to the source of transistor 530 and the gate of the transistor 540. One electrode of the OLED 560 is connected to the drain of the transistor 540 and the source of the transistor 550. A collecting transistor of Moc 565 is connected to the OLED 560 in the pixel.

Figure 6:
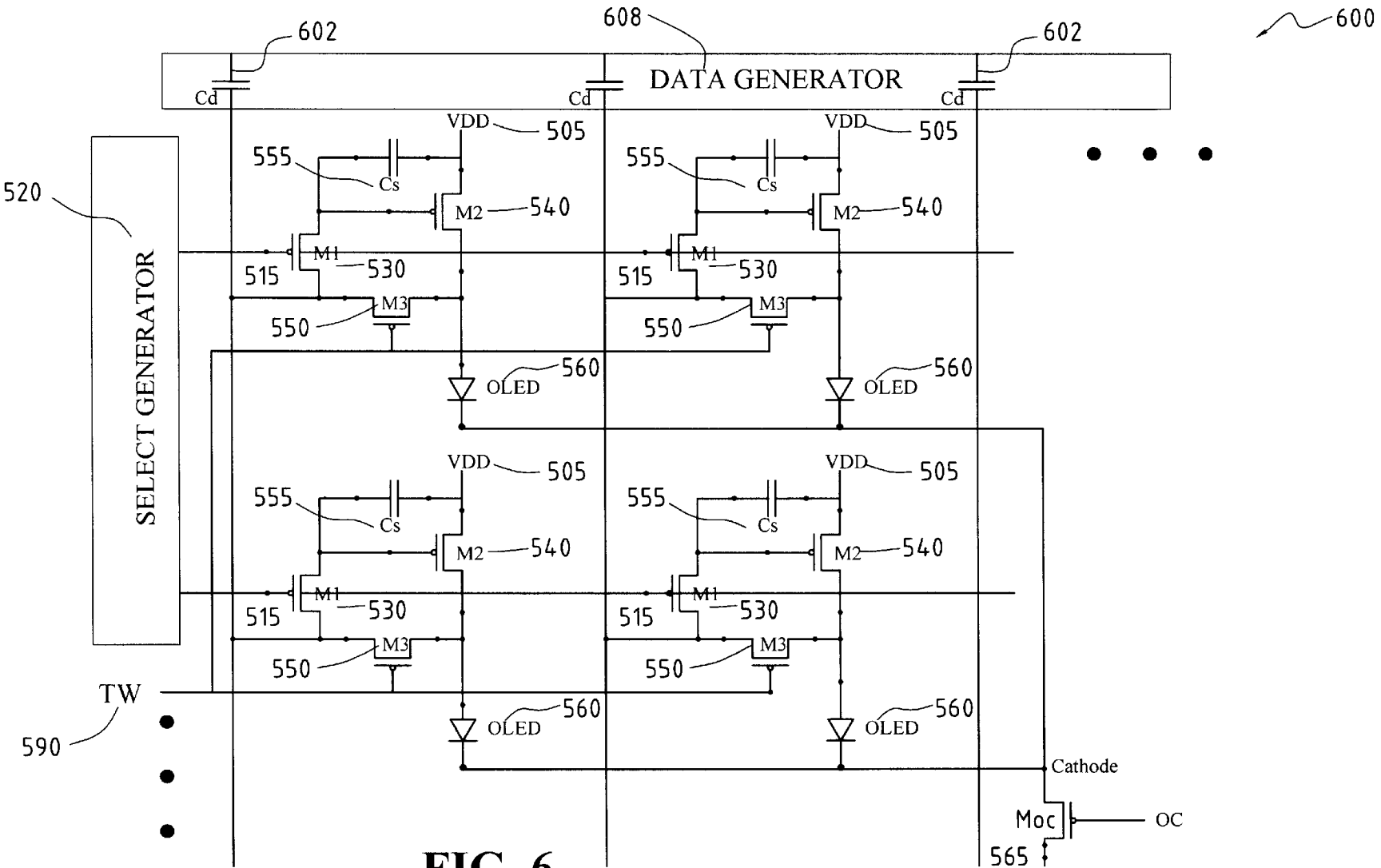
FIG. 6 depicts the display panel structure of a three transistors one capacitor and data capacitor embedded in a data generator of the display panel in the present invention.

FIG. 6 depicts a schematic diagram of a plane view of an active display panel structure of the present invention. In this preferred embodiment, it is obvious that the drain of the transistor 530 and the drain of the transistor 550 in every emitting pixel and are now extended out to connect to a data capacitor Cd 602 in the data generator region 608, in which the data generator region is now located on one side of the display panel. Furthermore, the lines connecting to the OLED of every pixel are now all collected to one end of a collecting transistor Moc 565, in which the Moc 565 is then located on the other side of the display panel and not in the pixel array region.

In sum, the emitting display plane panel structure can be concluded as being separated in five parts which include the data generator region 608 outside of the pixel, the select generator 520 outside of the pixel array region, the TW control line 590 outside of the pixel array region, the Moc transistor 565 outside of the pixel array region, and a plurality of pixels of arrays in the middle of the display panel.

Figure 7:
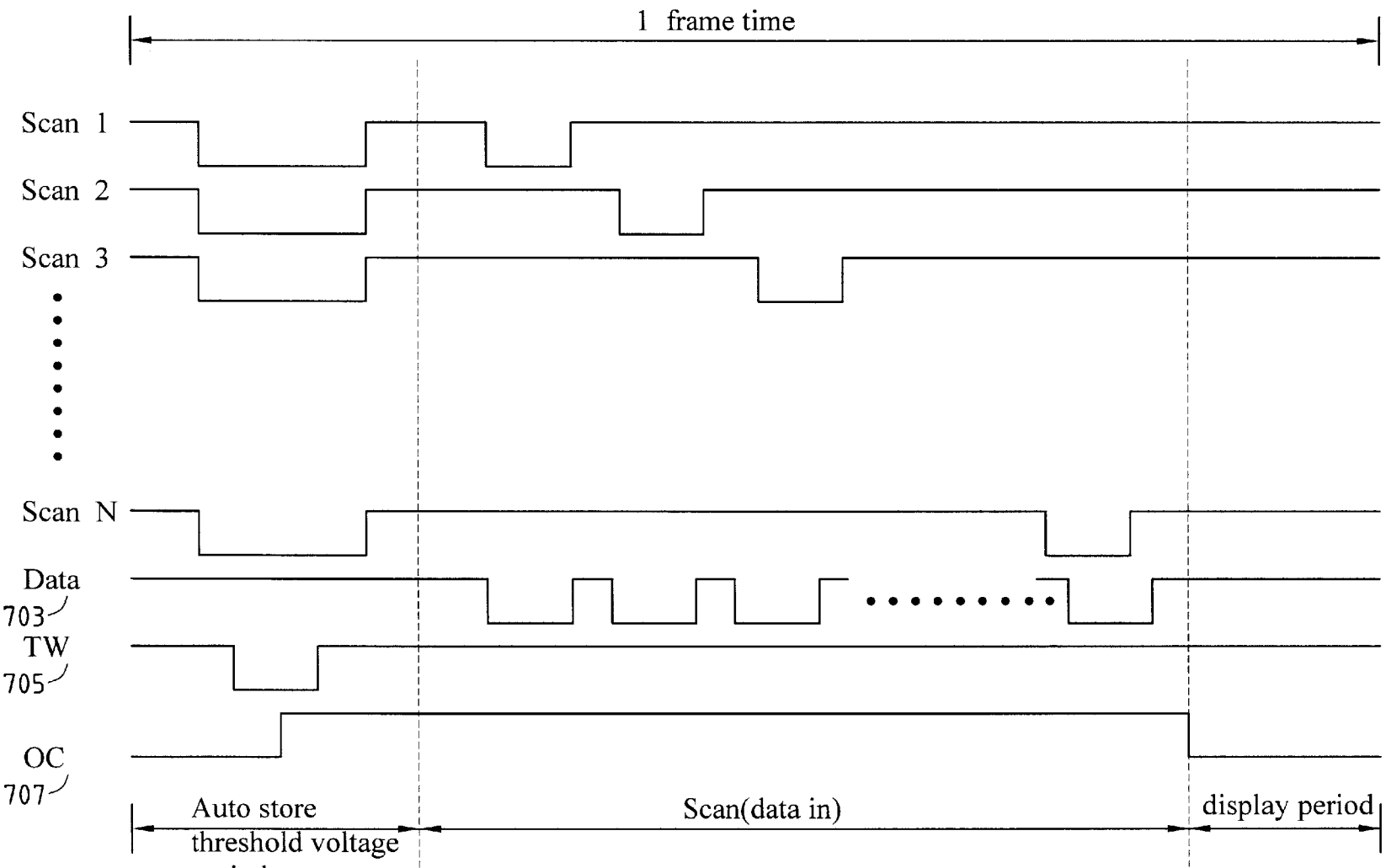
FIG. 7 depicts a drive circuit time domain diagram of the three transistors one capacitor circuit structure of the present invention.

FIG. 7 depicts a schematic diagram of a time domain of the control signal. In this diagram, the time domain is separated as the auto-store threshold voltage period and scan (data in) and display period. In the auto-store threshold voltage period, the scan1 to scan N are varied once in a frame time which can be easily seen from the diagram that the scan1, scan2, scan3, . . . , scanN are first starts "high" (which makes M1 'off') and then turns "low" (which makes M1 'on') after a while in the same instant. During the period of "low" of the scan1, scan2, scan3, . . . , scanN, the TW 705 is "high" then "low" and "high", while the OC 707 is first started "low" then "high". During the period when TW 705 is "low" and OC 707 is "low", a current will flow from Vdd 505 through M2 540, OLED 560 to the drain of Moc 565. Thus Cs capacitor 555 records a voltage in which it depends on the characteristics of M2 540 and the light element OLED 560. On the other hand, during the period of TW 705 "low", and OC "high", Moc 565 is then switched to "off" and Cs 555 auto-stores the threshold voltage of M2 540.

While during the scan (data in) and display period, every sequence of scanning step of "high" to "low", the variation of data signal will couple through Cd 602, M1 530 to Cs 555 and adds to the former threshold voltage in M2 540 of every pixels. After scanning all the scan lines, OC 707 is set from "high" to "low", so Moc 565 is switched "on". The wanted current flowing from Vdd 505 and running through M2 540, OLED 560 will makes the OLED 560 emit light more uniformly. So the current of OLED 560 will not depend on the threshold voltage of M2 540 and depends on the data signal coupled only.

The advantage of the scheme mentioned above, i.e., that the data capacitor Cd 602 connecting to all of the emitting pixels are collected in the data generator region 608 and the lines connecting to the OLED 560 of every pixel are now connected to a transistor Moc 565 which is located on the other side of the display panel. Through this arrangement, it can largely improve the aperture ratio of the pixel array. Moreover, the entire pixel array layout of this invention exhibits only the scan line 520, the data line 510, the Vdd line 505 and the TW control line 590 which can definitely simplify the display panel pixel control complicacy.

Figure 8:
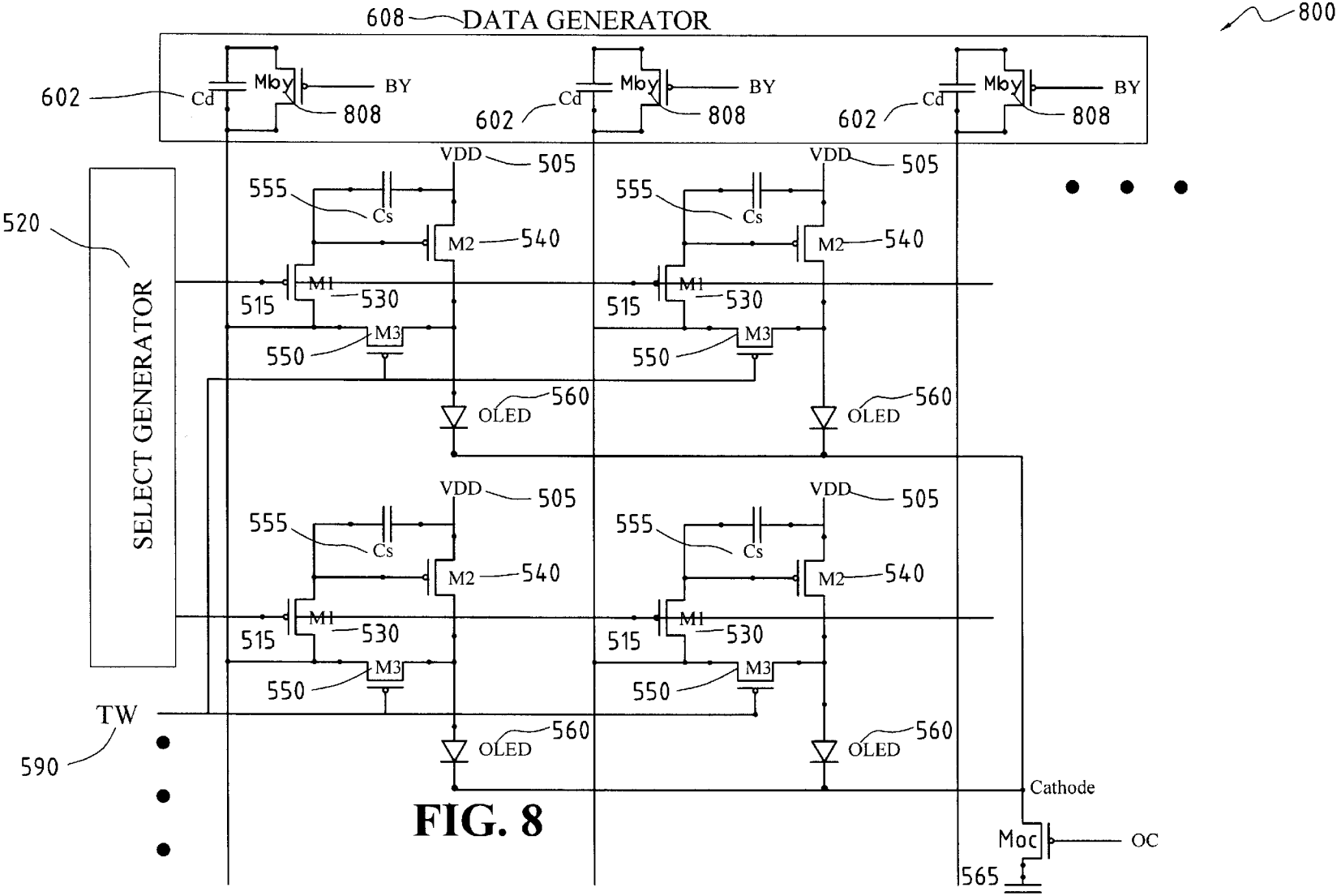
FIG. 8 depicts the drive circuit structure of the display panel with the addition of a by-pass transistor in parallel with the data capacitor in the data generator region of the present invention.
Figure 9:
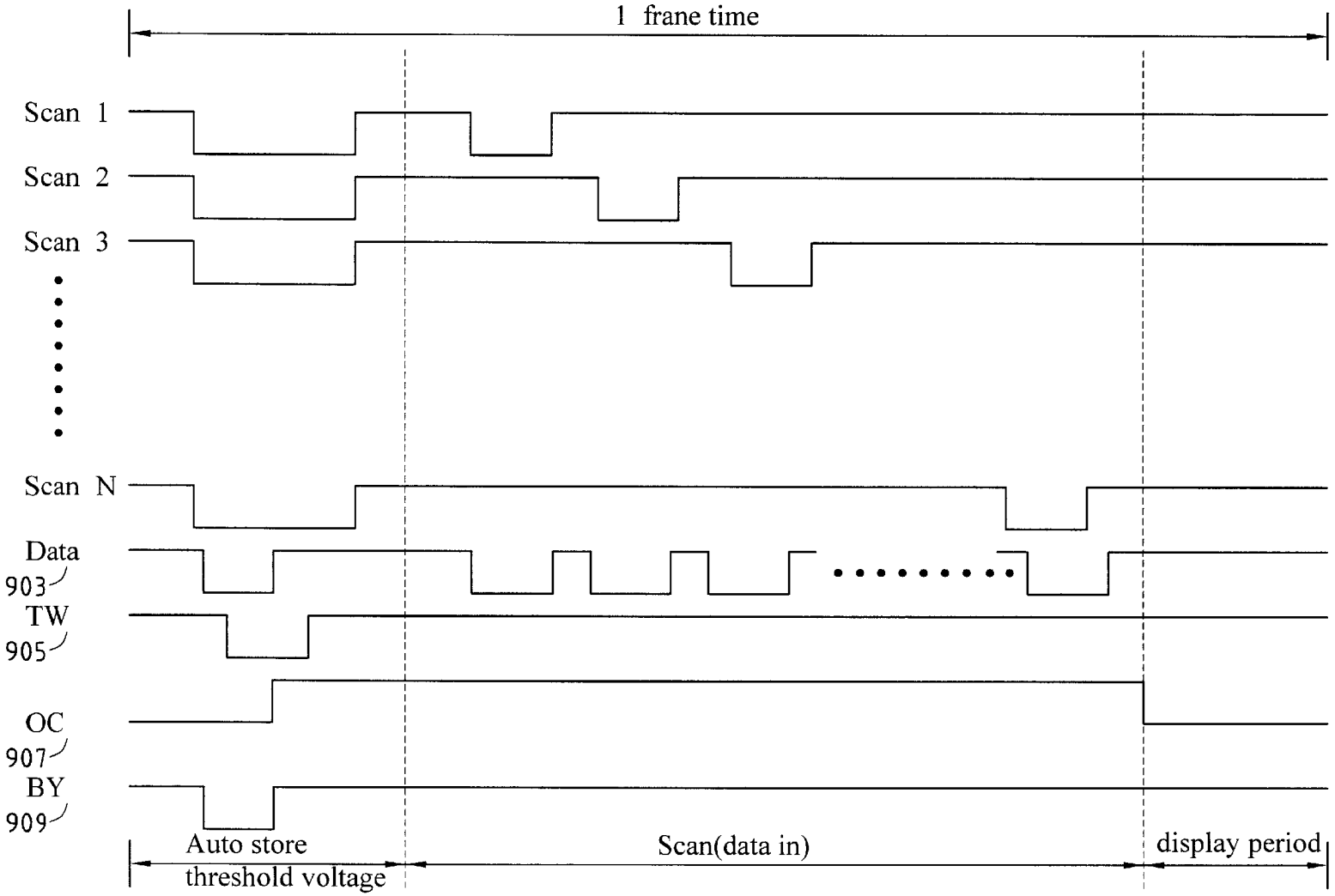
FIG. 9 depicts a drive circuit time domain diagram of the addition of a by-pass transistor in parallel with the data capacitor in the data generator region drive circuit.

In another preferred embodiment as shown in FIG. 8 and FIG. 9, the layout of the pixel structure is the same as that in FIG. 5 and FIG. 6, while the only distinction is the addition of a by-pass transistor Mby 808 which is in parallel with the data capacitor Cd 602 located in the data generator region 608. The function of the additional Mby 808 is to reduce the current of OLED during the auto-store threshold voltage period by switching lower data signal to the anode end of OLED. This kind of scheme can improve the contrast because reducing the current of OLED during the auto-store threshold voltage period would also reduce the unwanted light in the auto-store threshold voltage period.

FIG. 9 depicts a schematic diagram of a time domain of the control signal. In this diagram, the time domain is separated as the auto-store threshold voltage period and scan (data in) and display period. In the auto-store threshold voltage, the scan1 to scan N are varied once in a frame time which can be easily seen from the diagram that the scan1, scan2, scan3, . . . , scanN are first started "high" (which makes M1 "off") and then turned "low" (which makes M1 "on") after a while in the same instant. During the period of the scan1, scan2, scan3, . . . , scanN "low", TW 905 is "high" then "low" and "high", OC 907 is "low" then "high", BY 909 is "high" then "low" and "high". During the period of TW 905 "low" and OC 907 is "low", BY 909 is "low" which makes lower level data signal to the anode end of OLED. So only very low level of current flows from Vdd 505 through M2 540, OLED 560 to the drain of Moc 565. During the period of TW 905 "low", OC 907 "high" and BY "high", Moc 565 and Mby 808 are switched "off" and Cs 555 auto-stores the threshold voltage of M2 540.

Figure 10:
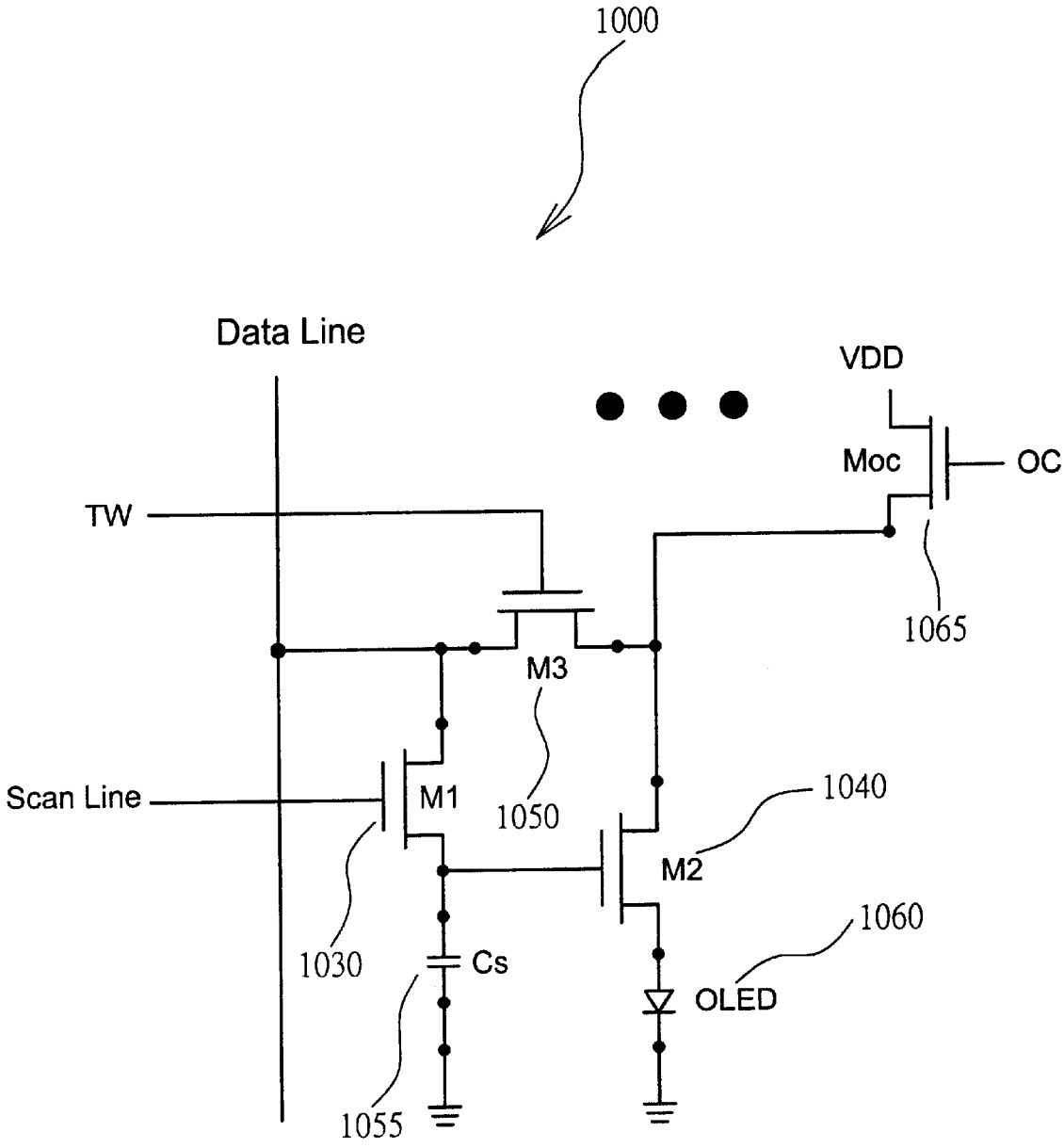
FIG. 10 depicts a three transistors one capacitor of pixel structure implemented by NMOS transistors of the present invention.

Although the present invention is described using PMOS transistors, it should be understood that the present invention be implemented using NMOS transistors, wherein the associated relevant voltage are reversed. As referring to FIG. 10, pixel structure 1000 comprises three NMOS transistors 1030, 1040, 1050, a storage capacitor Cs 1055, an OLED 1060 (light element) and a transistor Moc 1065. The main distinction between FIG. 10 and FIG. 5 is the NMOS M2 1040 instead of the PMOS M2 540 and the location of Moc transistor. Moreover in this scheme, not only functions of compensating the threshold voltage of M2 transistor but also threshold voltage of OLED 1060 are included.

As will be understood by persons skilled in the art, the foregoing preferred embodiment of the present invention is illustrative of the present invention rather than limiting the present invention. Having described the invention in connection with a preferred embodiment, modification will now suggest itself to those skilled in the art. Thus, the invention is not to be limited to this embodiment, but rather the invention is intended to cover various modifications and similar arrangements included within the spirit and scope of the appended claims, the scope of which should be accorded the broadest interpretation so as to encompass all such modification and similar structure.

While the preferred embodiment of the invention has been illustrated and described, it will be appreciated that various changes can be made therein without departing from the spirit and scope of the invention.

What is claimed is:

1. An uniformly emitting pixel structure for an active matrix display panel comprising:

a data generator region on the first side of said display panel having a plurality of data capacitors wherein said data capacitor having two ends and one end of said data capacitor is connected to every emitting pixel of said display panel;

a select generator on the second side of said display panel connecting to said every emitting pixel of said display panel;

a TW line connecting to said every emitting pixel;

a plurality of emitting pixels in the middle of said display panel, wherein said emitting pixel comprising:

a first transistor having a gate, a source and a drain, where said gate is connected to said select generator, where said drain is connected to said data generator region;

a storage capacitor having a first terminal and a second terminal, where said source of said first transistor is connected to said first terminal of said capacitor, where said second terminal of said capacitor is connected to a Vdd line or a common electrode;

a second transistor of PMOS transistor having a gate, a source and a drain, where said gate of said second transistor is connected to said source of said first transistor, where said gate of said second transistor is connected to said first terminal of said storage capacitor, where said source of said second transistor is connected to said Vdd line, where said source of said second transistor is connected to said second terminal of said storage capacitor;

a third transistor having a gate, a source and a drain, where said gate of said third transistor is connected to said TW line, where said drain of said third transistor is connected to said data capacitor in said data generator region, where said source of said third transistor is connected to said drain of said second transistor;

a light element in said every emitting pixel, where said source of said third transistor and said drain of said second transistor are connected to said light element; and a collecting transistor positioning on the third side of said display panel having a source, a drain and a gate, wherein said light element on said every pixel are connected to said source of said collecting transistor, said gate of said collecting transistor is connected to a control device OC.

2. The display of claim 1, wherein said light element is an organic light emitting diode (OLED).

3. The display of claim 1, wherein said second transistor is PMOS transistor.

4. The display of claim 1, wherein said data capacitor in said data generator region is connected to said emitting pixel in said pixel array.

5. The display of claim 1, wherein said data capacitors are located in said data generator region outside of the emitting pixel array and located on a side of said display panel.

6. The display of claim 1, wherein said collecting transistor is outside of said emitting pixel array and located on a side of said display panel.

7. An uniformly emitting pixel structure for an active matrix display panel comprising:

a data generator region on the first side of said display panel having a plurality of data capacitors wherein said data capacitor having two ends and one end of said data capacitor is connected to every emitting pixel of said display panel;

a select generator on the second side of said display panel connecting to said every emitting pixel of said display panel;

a TW line connecting to said every emitting pixel;

a plurality of emitting pixels in the middle of said display panel, wherein said emitting pixel comprising:

a first transistor having a gate, a source and a drain, where said gate is connected to said select generator, where said drain is connected to said data generator region;

a storage capacitor having a first terminal and a second terminal, where said source of said first transistor is connected to said first terminal of said storage capacitor, where said second terminal of said storage capacitor is connected to a Vdd line or a common electrode;

a second transistor of NMOS transistor having a gate, a source and a drain, where said gate of said second transistor is connected to said source of said first transistor, where said gate of said second transistor is connected to said first terminal of said storage capacitor;

a third transistor having a gate, a source and a drain, where said gate of said third transistor is connected to said TW line, where said drain of said third transistor is connected to said data capacitor in said data generator region, where said source of said third transistor is connected to said drain of said second transistor;

a light element in said every emitting pixel having a first terminal and a second terminal, where said source of said second transistor is connected to said first terminal of said light element, where said second terminal of said light element is connected to a common electrode;

a collecting transistor positioning on the third side of said display panel having a source, a drain and a gate, wherein said drain of said second transistor on said every pixel are connected to said source of said collecting transistor, said gate of said collecting transistor is connected to a control device OC, said drain of said collecting transistor is connected to a Vdd line.

8. The display of claim 7, wherein said light element is an organic light emitting diode (OLED).

9. The display of claim 7, wherein said second transistor is NMOS transistor.

10. The display of claim 7, wherein said data capacitor in said data generator region is connected to said emitting pixel in said pixel array.

11. The display of claim 7, wherein said data capacitors are located in said data generator region outside of the emitting pixel array and located on a side of said display panel.

12. The display of claim 7, wherein said collecting transistor is outside of said emitting pixel array and located on a side of said display panel.

13. An uniformly emitting pixel structure for an active matrix display panel comprising:

a data generator region having a plurality sets of data capacitor and by-pass transistor pairs in parallel, wherein said data generator region is on the first side of said display panel, wherein said data capacitor having two ends and one end of said data capacitor is connected to every emitting pixel of said display panel;

a select generator on the second side of said display panel connecting to said every emitting pixel of said display panel;

a TW line connecting to said every emitting pixel; and a plurality of emitting pixels in the middle of said display panel, wherein said emitting pixel comprising:

a first transistor having a gate, a source and a drain, where said gate is connected to said select generator, where said drain is connected to said data generator region;

a storage capacitor having a first terminal and a second terminal, where said source of said first transistor is connected to said first terminal of said storage capacitor, where said second terminal of said storage capacitor is connected to a Vdd line or a common electrode;

a second transistor of PMOS transistor having a gate, a source and a drain, where said gate of said second transistor is connected to said source of said first transistor, where said gate of said second transistor is connected to said first terminal of said storage capacitor, where said source of said second transistor is connected to said Vdd line, where said source of said second transistor is connected to said second terminal of said storage capacitor;

a third transistor having a gate, a source and a drain, where said gate of said third transistor is connected to said TW line, where said drain of said third transistor is connected to said data capacitor in said data generator region, where said source of said third transistor is connected to said drain of said second transistor;

a light element in said every emitting pixel, where said source of said third transistor and said drain of said second transistor are connected to said light element;

a collecting transistor positioning on the third side of said display panel having a source, a drain and a gate, wherein said light element on said every pixel are connected to said source of said collecting transistor, said gate of said collecting transistor is connected to a control device OC.

14. The display of claim 13, wherein said light element is an organic light emitting diode (OLED).

15. The display of claim 13, wherein said second transistor is PMOS transistor.

16. The display of claim 13, wherein said data capacitors and said by-pass transistors in said data generator region are connected to said emitting pixel array.

17. The display of claim 13, wherein said data capacitors and said by-pass transistors are located in said data generator region outside of the emitting pixel array for enhancing the contrast of the electroluminescent device.

18. The display of claim 13, wherein said data capacitors and said by-pass transistors are located in said data generator region outside of the emitting pixel array and located on a side of said display panel for improving the aperture ratio of the electroluminescent device.

19. An uniformly emitting pixel structure for an active matrix display panel comprising:

a data generator region having a plurality sets of data capacitor and by-pass transistor pairs in parallel, wherein said data generator region is on the first side of said display panel, wherein said data capacitor having two ends and one end of said data capacitor is connected to every emitting pixel of said display panel;

a select generator on the second side of said display panel connecting to said every emitting pixel of said display panel; a TW line connecting to said every emitting pixel; and a plurality of emitting pixels in the middle of said display panel, wherein said emitting pixel comprising:

a first transistor having a gate, a source and a drain, where said gate is connected to said select generator, where said drain is connected to said data generator region;

a storage capacitor having a first terminal and a second terminal, where said source of said first transistor is connected to said first terminal of said storage capacitor, where said second terminal of said storage capacitor is connected to a Vdd line or a common electrode;

a second transistor of NMOS transistor having a gate, a source and a drain, where said gate of said second transistor is connected to said source of said first transistor, where said gate of said second transistor is connected to said first terminal of said storage capacitor;

a third transistor having a gate, a source and a drain, where said gate of said third transistor is connected to said TW line, where said drain of said third transistor is connected to said data capacitor in said data generator region, where said source of said third transistor is connected to said drain of said second transistor;

a light element in said every emitting pixel having a first terminal and a second terminal, where said source of said second transistor is connected to said first terminal of said light element, where said second terminal of said light element is connected to a common electrode;

a collecting transistor positioning on the third side of said display panel having a source, a drain and a gate, wherein said drain of said second transistor on said every pixel are connected to said source of said collecting transistor, said gate of said collecting transistor is connected to a control device OC, said drain of said collecting transistor is connected to a Vdd line.

20. The display of claim 19, wherein said light element is an organic light emitting diode (OLED).

21. The display of claim 19, wherein said second transistor is NMOS transistor.

22. The display of claim 19, wherein said data capacitors and said by-pass transistors in said data generator region are connected to said emitting pixel array.

23. The display of claim 19, wherein said data capacitors and said by-pass transistors are located in said data generator region outside of the emitting pixel array for enhancing the contrast of the electroluminescent device.

24. The display of claim 19, wherein said data capacitors and said by-pass transistors are located in said data generator region outside of the emitting pixel array and located on a side of said display panel for improving the aperture ratio of the electroluminescent device.

* * * * *